US011673245B2

(12) United States Patent
Ohlsson

(10) Patent No.: US 11,673,245 B2
(45) Date of Patent: Jun. 13, 2023

(54) STAPLER

(71) Applicant: Isaberg Rapid AB, Hesta (SE)

(72) Inventor: Robert Ohlsson, Bredaryd (SE)

(73) Assignee: Isaberg Rapid AB, Hesta (SE)

( * ) Notice: Subject to any disclaimer, the term of this patent is extended or adjusted under 35 U.S.C. 154(b) by 0 days.

(21) Appl. No.: 17/768,422

(22) PCT Filed: Sep. 7, 2020

(86) PCT No.: PCT/EP2020/074902
§ 371 (c)(1),
(2) Date: Apr. 12, 2022

(87) PCT Pub. No.: WO2021/078435
PCT Pub. Date: Apr. 29, 2021

(65) Prior Publication Data

US 2022/0362914 A1 Nov. 17, 2022

(30) Foreign Application Priority Data

Oct. 24, 2019 (DE) ..... 10 2019 128 704.9

(51) Int. Cl.
*B25C 5/02* (2006.01)

(52) U.S. Cl.
CPC ..... *B25C 5/0271* (2013.01)

(58) Field of Classification Search
CPC ..... B25C 5/0271; B25C 5/1679; B25C 5/025; B25C 5/0207
See application file for complete search history.

(56) References Cited

U.S. PATENT DOCUMENTS 5,516,025 A * 5/1996 Eriksson ..... B25C 5/0207 227/155
5,678,745 A * 10/1997 Yoshie ..... B25C 5/0207 227/4

(Continued)

FOREIGN PATENT DOCUMENTS

DE 85140 A 7/1895
EP 1704968 A1 9/2006

(Continued)

OTHER PUBLICATIONS

International Search Report for Application No. PCT/EP2020/074902 dated Dec. 8, 2020 (5 pages).

(Continued)

*Primary Examiner* — Anna K Kinsaul
*Assistant Examiner* — Luis G Del Valle
(74) *Attorney, Agent, or Firm* — Michael Best & Friedrich, LLP

(57) ABSTRACT

A stapler for stapling sheet material with staples, each staple having two staple legs and a staple crown. The stapler having an anvil arm, with a stapling unit being pivotable relative to the anvil arm and including a staple magazine receiving the staples and a driver for pushing staples through the sheet material, with a base part, on which the anvil arm is mounted movably towards it, and with two two-armed bending levers pivotably mounted on the anvil arm about a respective pivot axis, each bending lever having a first and a second lever arm. Upon approach of the anvil arm to the base part, the second lever arms are pivoted and bend the staple legs. The pivot axes extend substantially perpendicular to the staple crowns and the second lever arms have end portions which are arranged offset to one another in the axial direction of the pivot axes.

9 Claims, 6 Drawing Sheets

(56) References Cited

U.S. PATENT DOCUMENTS

| | | | | |
|---|---|---|---|---|
| 6,702,172 | B1 * | 3/2004 | H.ang.kansson | B27F 7/19 227/119 |
| 7,124,926 | B1 * | 10/2006 | Tsai | B25C 5/0207 227/79 |
| 2004/0262363 | A1 * | 12/2004 | Elonsson | B25C 5/0207 227/76 |
| 2006/0118593 | A1 * | 6/2006 | Tsai | B25C 5/0207 227/155 |
| 2006/0163311 | A1 * | 7/2006 | Tsai | B25C 5/0207 227/79 |
| 2006/0266789 | A1 * | 11/2006 | Tsai | B25C 5/0207 227/155 |
| 2007/0023474 | A1 * | 2/2007 | Smith | B25C 5/0207 227/154 |
| 2007/0210135 | A1 * | 9/2007 | Ivarsson | B25C 5/0207 227/134 |
| 2014/0001227 | A1 * | 1/2014 | McNeill | B25C 5/0271 227/120 |

FOREIGN PATENT DOCUMENTS

| | | | | |
|---|---|---|---|---|
| EP | 1731268 | A1 | 12/2006 | |
| EP | 1480788 | B1 | 9/2008 | |
| WO | WO-03057417 | A1 * | 7/2003 | B25C 5/0207 |

OTHER PUBLICATIONS

International Preliminary Report on Patentability for PCT/EP2020/074902, dated Apr. 26, 2022 (5 pages).

* cited by examiner

STAPLER

BACKGROUND

The invention relates to a stapler.

Such a stapler is known from EP 1 480 788 B1. The configuration thereof with an anvil arm that is movable towards a stapler base part against a restoring force and with two-armed bending levers that are pivotably mounted on the anvil arm and, when the anvil arm is pushed down, bend the staple legs that have been passed through the sheet material and cut off excess end parts of the staple legs by pressing against the cutting edges of the cutting pad makes it possible to always use the same staples for sheet material with very different total thicknesses. If only a few sheets of paper are stapled together, for the total thickness of which the staple legs are actually too long, their excess end parts are simply cut off. In order that they do not collide with one another during the bending operation, the bending levers are arranged offset to one another in a direction that extends perpendicular to the staple crowns of the staples received in the staple magazine. In order nevertheless for both staple legs to be acted upon by in each case one of the bending levers, the pivot axes of the bending levers are also not arranged in the direction extending perpendicular to the staple crowns but rather in a manner twisted out of this direction. As a result, the staple legs are not bent exactly towards the staple crown during bending but rather to some extent next to it. This results, when the excess end parts are cut off, in a cut edge that does not extend perpendicular to the longitudinal extension of the staple legs. This can lead to increased wear of the cutting edges or even in jamming of the staple legs at the cutting edges.

Therefore, it is an object of the invention to develop a stapler of the type mentioned at the beginning such that it is less susceptible to wear and/or faults.

This object is achieved according to the invention by a stapler having the features of claim 1. Advantageous developments of the invention are the subject matter of the dependent claims.

SUMMARY OF THE INVENTION

The invention is based on the idea of configuring the second lever arms of the bending levers such that, during the bending operation, they are moved past one another even when they are arranged opposite one another with pivot axes extending substantially perpendicular to the staple crowns of the staples received in the staple magazine. The pivot axes each extend in this case at an angle of 90°±2° and preferably at an angle of 90°±1° to the staple crowns. Ideally, each of the pivot axes extends, within normal manufacturing accuracies, exactly perpendicular to the staple crowns of the staples received in the staple magazine. The bending levers can then be arranged opposite one another at the same position, meaning that they are at the same distance from the free end of the stapler base part.

Preferably, the thickness of the end portions measured in the axial direction of the pivot axis is smaller than the maximum thickness of the first lever arms. It is further preferred here that both bending surfaces have the same extension in the axial direction of the pivot axes. While the bending surfaces should be as large as possible, in order to reliably capture the staple legs passed through the sheet material, it is advantageous when the end portions are embodied in a thinner manner such that they can be guided readily past one another during the bending operation.

The first lever arms are expediently arranged in mirror symmetry to each other with respect to a symmetry plane extending perpendicular to the staple crowns of the staples received in the staple magazine in the middle between the pivot axes. This makes it easier to deform the staple legs as symmetrically as possible. It is further preferred here that the thickness of the end portions is at most half as large as the maximum thickness of the first lever arms, in order for it to be possible to move the end portions reliably past one another.

The pivot axes are advantageously arranged at such a distance from each other that the first lever arms are movable past the cutting edges. They can then be moved further even after the excess end parts of the staple legs have been severed, until the staple legs are pressed against the rear side of the stapled sheet material.

The support plate expediently has on both sides of the cutting pad openings for passing through the free ends of the staple legs after piercing the sheet material. In order for it to be possible to press the staple legs against the underside of the stapled sheet material, the bending surfaces are advantageously pivotable upon approach of the anvil arm to the base part in each case from a rest position, in which they are arranged at a positive acute angle to a support surface on the upper side of the support plate, into a stapling position, in which they are arranged parallel or at a negative acute angle to the support surface.

BRIEF DESCRIPTION OF THE DRAWINGS

The invention is explained in more detail in the following text with reference to an exemplary embodiment illustrated schematically in the drawing, in which.

DETAILED DESCRIPTION

Figure 3A:
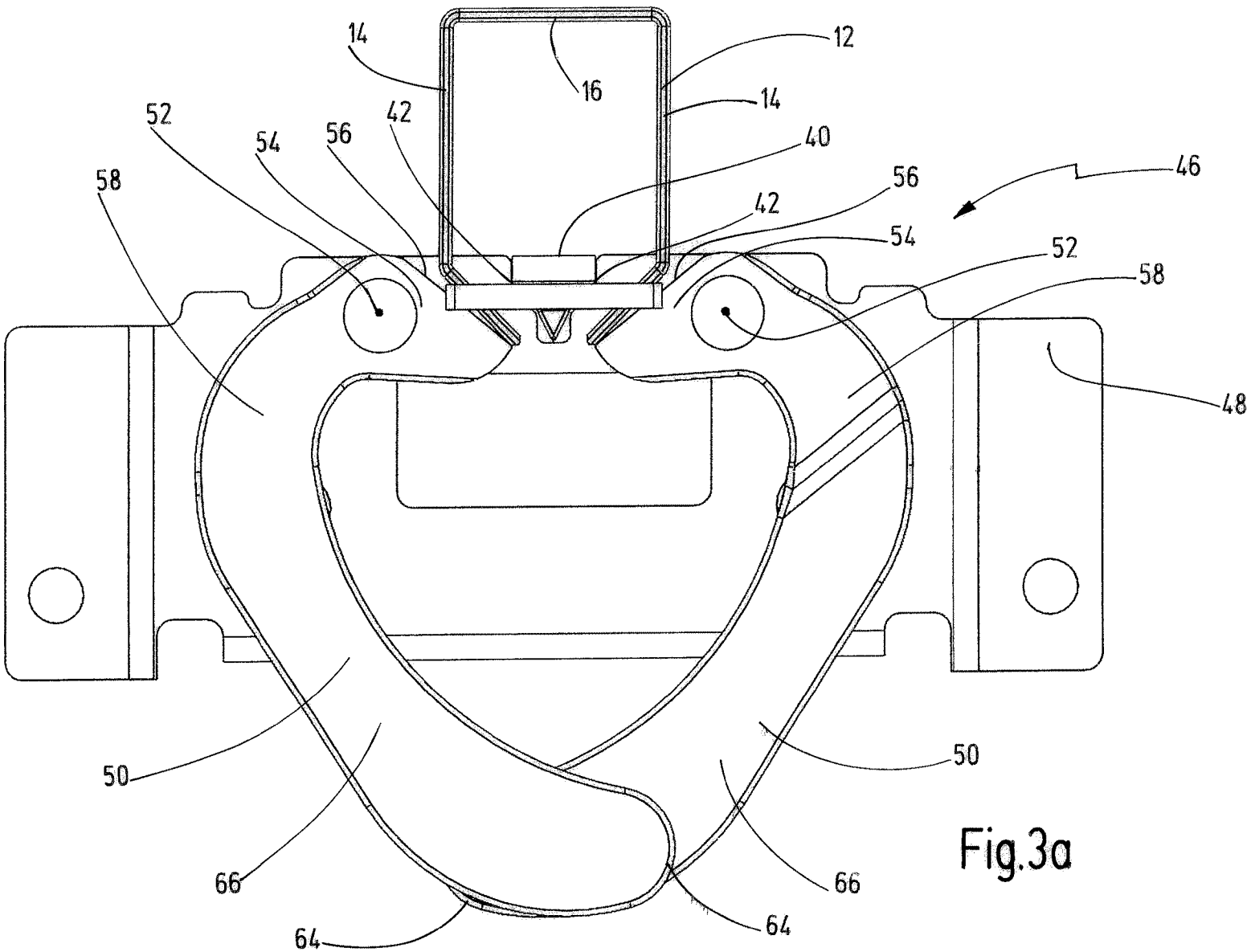
FIG. 3*a*, 3*b* show the assembly according to FIG. 2 in side view, wherein one of the side plates has been removed, with the bending levers in two different positions.
Figure 3B:
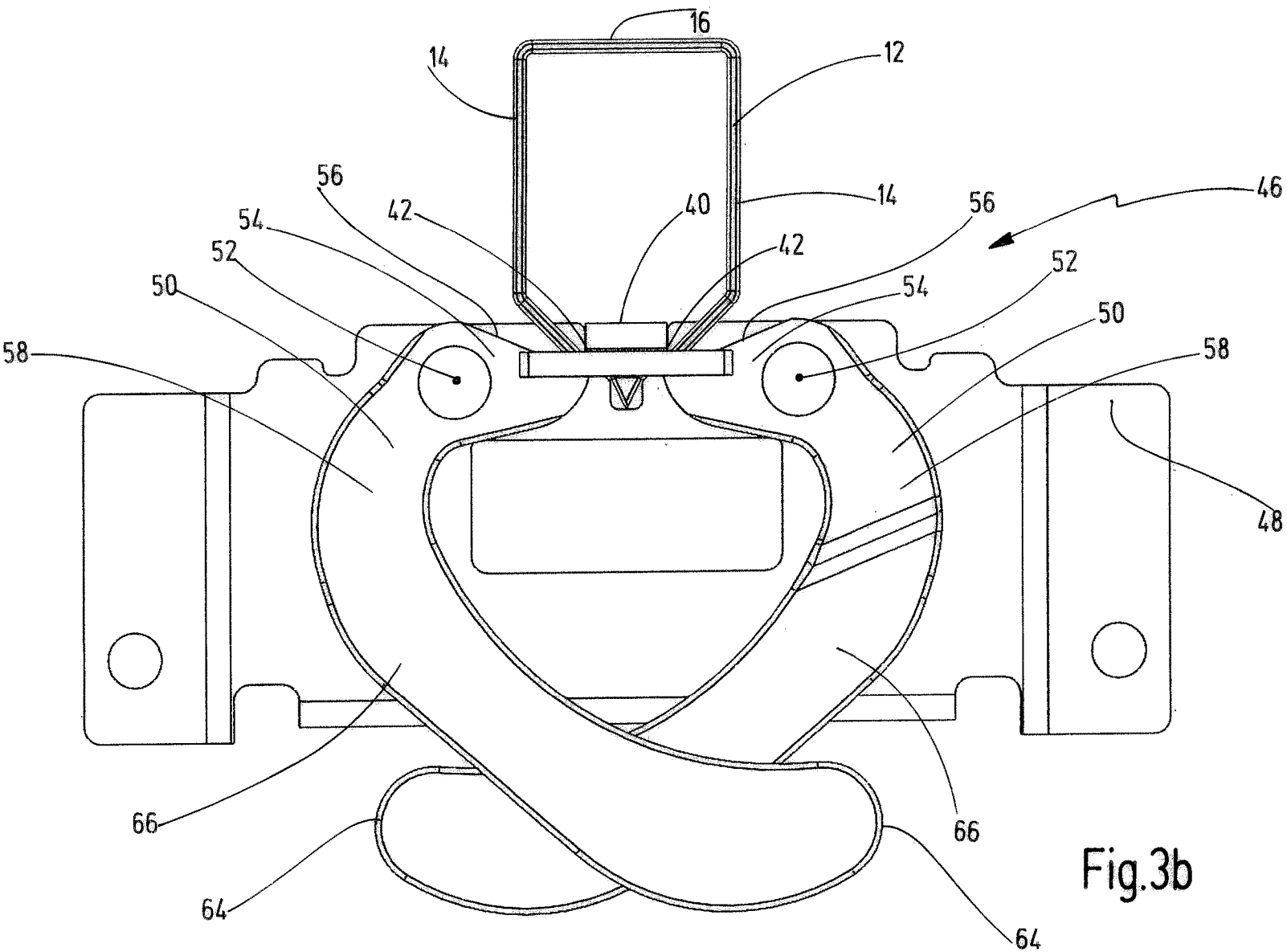
Figure 4A:
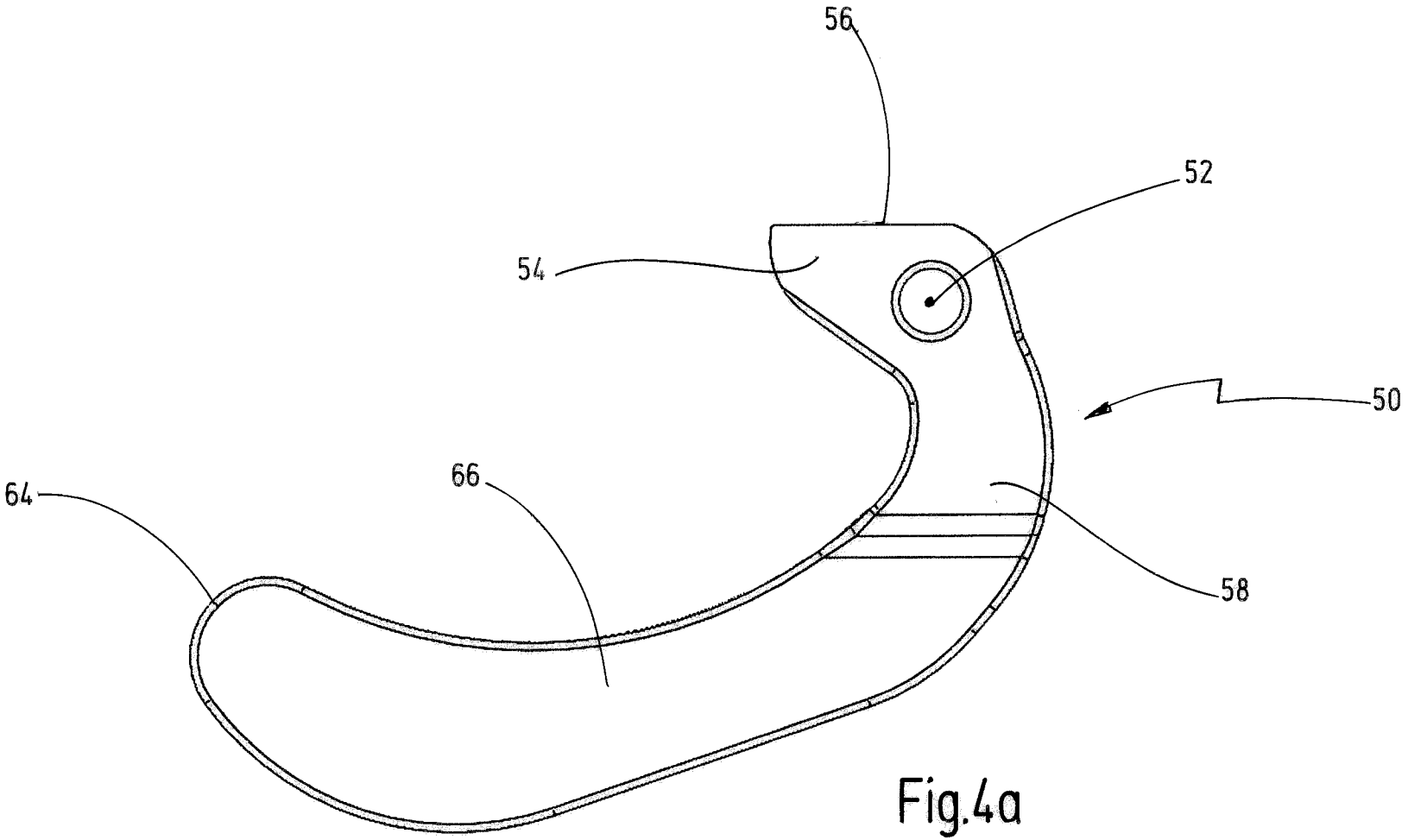
FIG. 4*a*, 4*b* show a bending lever in side view and in a perspective view.
Figure 4B:
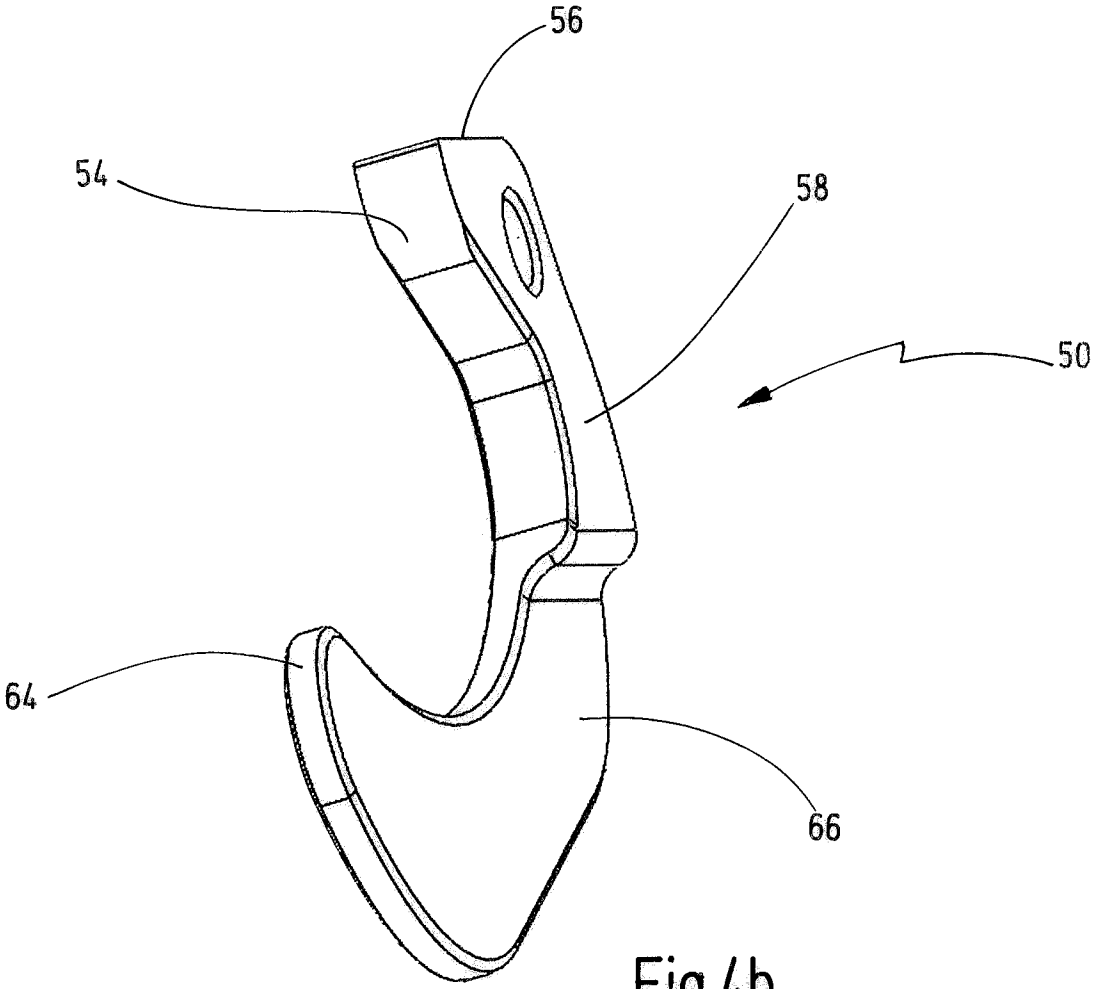

The stapler 10 illustrated in the drawing serves to staple sheet material by means of staples 12, which, as is apparent from FIG. 3*a*, 3*b*, each have two staple legs 14 and a staple crown 16 interconnecting the staple legs 14 and extending transversely to them. The staples 12 thus have the shape of a downwardly open U, wherein during the stapling operation, the staple legs 14 pierce the sheet material with their free ends and are bent over on the underside of the sheet material.

The stapler has a base part 18, which extends in a longitudinal direction 20 from a rear end 22 to a front end 24 and bears an anvil arm 26, which is mounted on the base part 18 movably towards it against a restoring force, for example of a spring. In the present exemplary embodiment, the anvil arm 26 is mounted pivotably on the base part 18 in the region of a bearing block 28 arranged close to the rear end 22. The stapler 10 also has a stapling unit 30, which has a staple magazine 32 in which the staples 12 are arranged in a row alongside one another. In this row, the staple crowns are oriented parallel to one another, wherein each staple crown 16 apart from the frontmost one and the rearmost one is arranged between two adjacent staple crowns 16 and bears against them. The stapling unit 30 also has a hand lever 34, which protrudes obliquely upwards from the bearing block 28 and extends in the direction of the rear end 22. Arranged on the hand lever 34 is a driver 36, and the hand lever 34 is mounted on the bearing block 28 so as to be pivotable downwards with respect to the base part 18 and the staple magazine 32 in each case against a restoring force. In addition, the staple magazine 32 is mounted on the bearing block 28 so as to be pivotable with respect to the base part 18. The anvil arm 26 has a support plate 38 for supporting the sheet material, wherein during the stapling operation, the hand lever 34 is pushed down, in the process pushes down the staple magazine 32 onto the sheet material, and wherein finally, with application of a greater force, the driver 36 pushes the frontmost staple 12 with the free ends of its staple legs 14 first through the sheet material.

Figure 2:
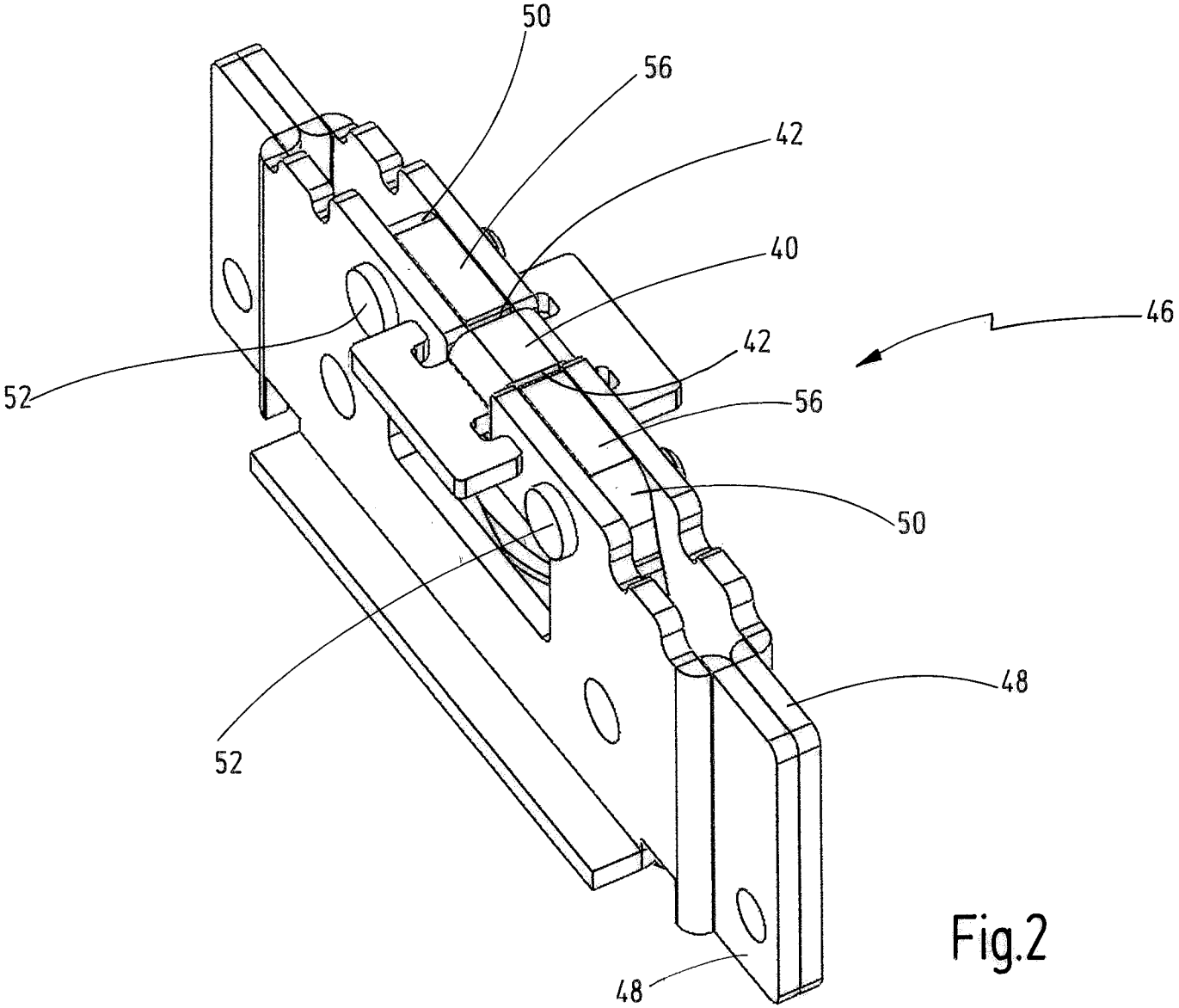
FIG. 2 shows an assembly, installed in the stapler according to FIG. 1, with a cutting pad and two bending levers.

The stapler 10 is distinguished by the fact that, for sheet material of different thicknesses, in the present case for sheet material consisting of 2 to 170 sheets of paper, only staples 12 of a single size are required, since excess end parts of the staple legs 14 are cut off during the stapling operation. For this purpose, the anvil arm bears a cutting pad 40 with two cutting edges 42 on mutually remote sides of the cutting pad 40, wherein a projection of the cutting edges 42 onto the underside standing surface 44 of the base part 18, with which the stapler 10 is able to be placed flat on an underlying surface, for example a desk, extends in the longitudinal direction 20. Thus, the cutting edges 42 also always extend, within the scope of normal manufacturing accuracies, perpendicular to the staple crowns 16 of the staples 12 received in the staple magazine 32, since the row of staples 12 likewise extends in the longitudinal direction 20 in its projection onto the standing surface 44. An assembly 46 illustrated in FIG. 2, 3*a*, 3*b*, to which the cutting pad 40 belongs, and which is connected firmly to the anvil arm 26, also has two identical bending levers 50 arranged between two side plates 48. Each of the bending levers 50 is mounted pivotably about a pivot axis 52 on the anvil arm 26 between the side plates 48. It has a first lever arm 54, which has a bending surface 56 on the top side, and a longer second lever arm 58, which rests on the base part 18. The projection of the pivot axes 52 into the standing surface 44 extends in this case in the longitudinal direction 20. The pivot axes 52 thus extend, within manufacturing tolerances, perpendicular to the staple crowns 16 of the staples 12 received in the staple magazine 32.

Figure 1:
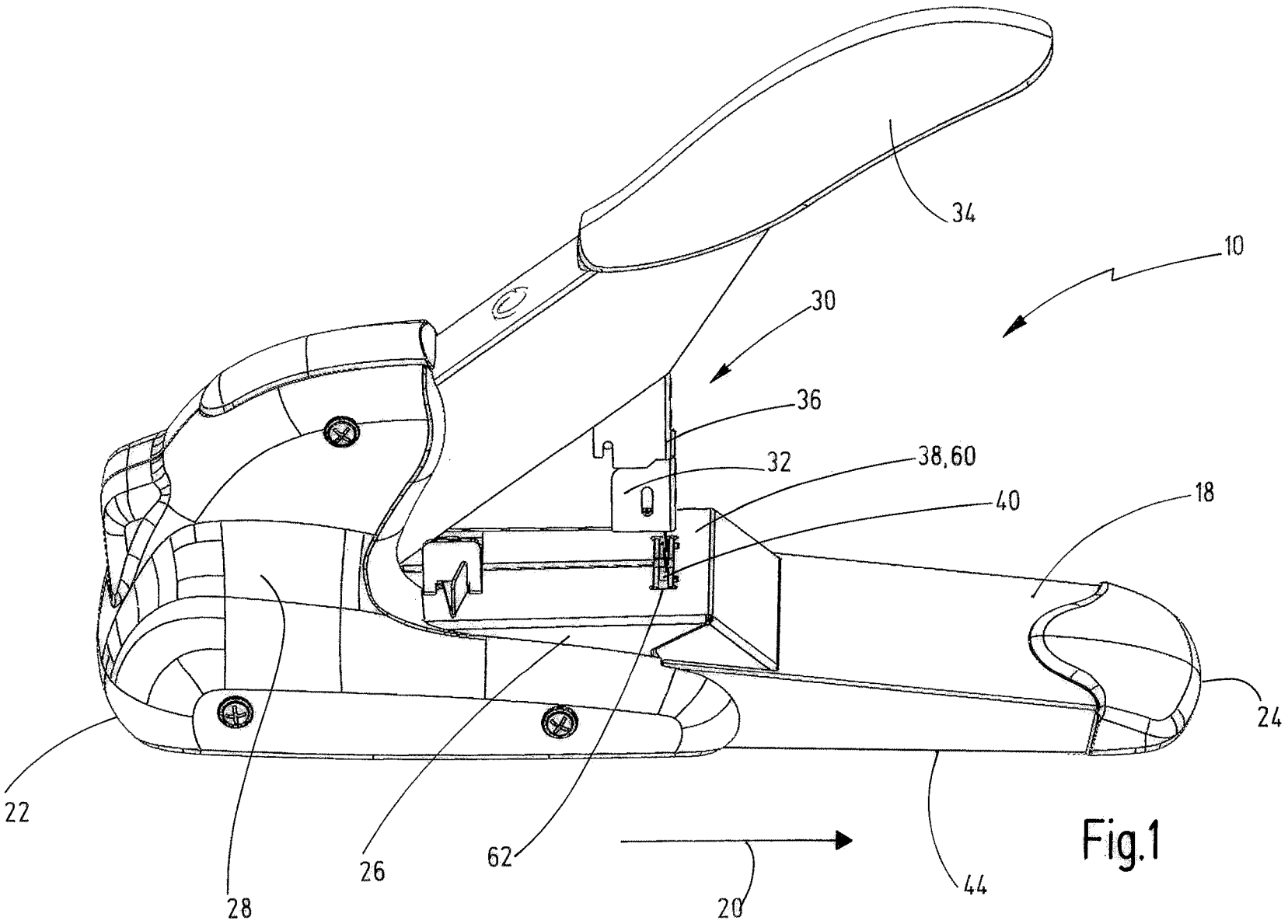
FIG. 1 shows a perspective illustration of a stapler.

When the anvil arm 26 is pushed down in the direction of the base part 18 during the stapling operation, the second lever arms 58 are pressed onto the bottom of the base part 18, such that the pushing down results in the bending levers 50 pivoting about the pivot axes 52. In the rest position, illustrated in FIG. 1, of the stapler 10, the bending levers 50 are likewise in a rest position, in which the bending surfaces 56 are arranged at a positive acute angle to a support surface 60 on the top side of the support plate 38. This angle decreases during the stapling operation, i.e. while the bending levers 50 are being pivoted. In the process, the free ends of the staple legs 14, after piercing the sheet material, each come to rest on one of the bending surfaces 56, and the end portions of the staple legs 14 that have pierced the sheet material are bent towards one another by means of pivoting of the bending levers 50. Any excess end parts of the staple legs 14, which are embodied in a very long manner in the present exemplary embodiment, are pressed against the cutting edges 42 by the bending levers 50 during the bending and cut off. In order to be able to come to rest against the bending surfaces 56, the staple legs 14, after piercing the sheet material, are passed with their free ends through openings 62 in the support plate 38. The pivot axes 52 are arranged at such a distance from one another and the first lever arms 54 are dimensioned in such a manner that the latter are movable past the cutting edges 42 during the pivoting of the bending levers 50. The bending levers 50 can then be pivoted out of the rest position and into an end position, in which their bending surfaces 56 are arranged parallel or at a negative acute angle to the support surface.

The first lever arms 54 are arranged in mirror symmetry to each other with respect to a symmetry plane extending in the longitudinal direction 20 in the middle between the pivot axes 52. In the axial direction of the pivot axes 52, the bending surfaces 56 also have the same extension. By contrast, the second lever arms 58 have end portions 66 beginning at their free ends 64 and extending to some extent in the direction of the respective pivot axis 52, the thickness of which end portions 66, measured in the axial direction of the pivot axes 52, being smaller than the maximum thickness of the first lever arms, which is defined by the extension of the bending surface 56 in the axial direction of the pivot axes 52. The thickness of the end portions 66 is in this case smaller than half the maximum thickness of the first lever arms 54, such that the end portions 66, as shown in FIG. 3*a*, 3*b*, can be moved past one another during the stapling operation, without colliding with one another.

In summary, the following should be stated: The invention relates to a stapler 10 for stapling sheet material by means of staples 12, each staple 12 having two staple legs 14 and a staple crown 16 interconnecting the staple legs 14 and extending transversely to them, with an anvil arm 26 having a support plate 38 for placing the sheet material thereon, the anvil arm 26 carrying a cutting pad 40 with two cutting edges 42 for cutting off excess end parts of the staple legs 14, with a stapling unit 30 that is pivotally mounted relative to the anvil arm 26, which stapling unit 30 comprises a staple magazine 32 receiving the staples 12 in a row with the staple crowns 16 mutually abutting and being aligned parallel to each other and a driver 36 for pushing individual staples 12 with the free ends of their staple legs 14 first through the sheet material, with a base part 18, on which the anvil arm 16 is mounted movably towards it against a restoring force, and with two two-armed bending levers 50 pivotably mounted on the anvil arm 26 about a respective pivot axis 52, each bending lever 50 having a first lever arm 54 with a bending surface 56 for bending the staple legs 14 and a second lever arm 58, wherein upon approach of the anvil arm 26 to the base part 18, the second lever arms 58 are pivoted by action of the base part 18 about the pivot axes 52 and the bending surfaces 56 bend the staple legs 14 towards each other and cut off any excess end portions by pressing against the cutting edges 42. According to the invention, it is provided that the pivot axes 52 extend substantially perpendicular to the staple crowns 16 of the staples 12 received in the staple magazine 32 and that the second lever arms 58 have end portions 66 beginning at their free ends 64 which are arranged offset to one another in the axial direction of the pivot axes 52 so that they move past one another as the anvil arm 26 approaches the base part 18.

The invention claimed is:

1. Stapler for stapling sheet material by means of staples (12), each staple (12) having two staple legs (14) and a staple crown (16) interconnecting the staple legs (14) and extending transversely to them, with an anvil arm (26) having a support plate (38) for placing the sheet material thereon, the anvil arm (26) carrying a cutting pad (40) with two cutting edges (42) for cutting off excess end parts of the staple legs (14), with a stapling unit (30) that is pivotally mounted relative to the anvil arm (26), which stapling unit (30) comprises a staple magazine (32) receiving the staples (12) in a row with the staple crowns (16) mutually abutting and being aligned parallel to each other and a driver (36) for pushing individual staples (12) with the free ends of their staple legs (14) first through the sheet material, with a base part (18), on which the anvil arm (16) is mounted movably towards it against a restoring force, and with two two-armed bending levers (50) pivotably mounted on the anvil arm (26) about a respective pivot axis (52), each bending lever (50) having a first lever arm (54) with a bending surface (56) for bending the staple legs (14) and a second lever arm (58), wherein upon approach of the anvil arm (26) to the base part (18), the second lever arms (58) are pivoted by action of the base part (18) about the pivot axes (52) and the bending surfaces (56) bend the staple legs (14) towards each other and cut off any excess end portions by pressing against the cutting edges (42), wherein the pivot axes (52) extend at an angle of 90+/−2 degrees to the staple crowns (16) of the staples (12) received in the staple magazine (32) and that the second lever arms (58) have end portions (66) beginning at their free ends (64) which are arranged offset to one another in the axial direction of the pivot axes (52) so that they move past one another as the anvil arm (26) approaches the base part (18), and wherein a thickness of the end portions (66) measured in the axial direction of the pivot axes (52) is smaller than a maximum thickness of the first lever arms (54) measured in the axial direction of the pivot axes (52).

2. Stapler according to claim 1, characterized in that both bending surfaces (56) have the same extension in the axial direction of the pivot axes (52).

3. Stapler according to claim 2, characterized in that the first lever arms (54) are arranged in mirror symmetry to each other with respect to a symmetry plane extending perpendicular to the staple crowns (16) of the staples (12) received in the staple magazine (32) in the middle between the pivot axes (52).

4. Stapler according to claim 1, characterized in that the thickness of the end portions (66) is at most half as large as the maximum thickness of the first lever arms (54).

5. Stapler according to claim 1, characterized in that the pivot axes (52) are arranged at such a distance from each other, that the first lever arms (54) are movable past the cutting edges (42).

6. Stapler according to claim 1, characterized in that the support plate (38) on both sides of the cutting pad (40) has openings (62) for passing through the free ends of the staple legs (14) after piercing the sheet material.

7. Stapler according to claim 1, characterized in that the bending surfaces (56) are pivoted upon approach of the anvil arm (26) to the base part (18) in each case from a rest position in which they are arranged at a positive acute angle to a support surface (60) on the upper side of the support plate (38) into a stapling position in which they are arranged parallel or at a negative acute angle to the support surface (60).

8. Stapler according to claim 1, characterized in that the pivot axes (52) extend at an angle of 90+/−1 degree to the staple crowns (16) of the staples (12) received in the staple magazine (32).

9. Stapler for stapling sheet material by means of staples (12), each staple (12) having two staple legs (14) and a staple crown (16) interconnecting the staple legs (14) and extending transversely to them, with an anvil arm (26) having a support plate (38) for placing the sheet material thereon, the anvil arm (26) carrying a cutting pad (40) with two cutting edges (42) for cutting off excess end parts of the staple legs (14), with a stapling unit (30) that is pivotally mounted relative to the anvil arm (26), which stapling unit (30) comprises a staple magazine (32) receiving the staples (12) in a row with the staple crowns (16) mutually abutting and being aligned parallel to each other and a driver (36) for pushing individual staples (12) with the free ends of their staple legs (14) first through the sheet material, with a base part (18), on which the anvil arm (16) is mounted movably towards it against a restoring force, and with two two-armed bending levers (50) pivotably mounted on the anvil arm (26) about a respective pivot axis (52), each bending lever (50) having a first lever arm (54) with a bending surface (56) for bending the staple legs (14) and a second lever arm (58), wherein upon approach of the anvil arm (26) to the base part (18), the second lever arms (58) are pivoted by action of the base part (18) about the pivot axes (52) and the bending surfaces (56) bend the staple legs (14) towards each other and cut off any excess end portions by pressing against the cutting edges (42), wherein the pivot axes (52) extend at an angle of 90+/−2 degrees to the staple crowns (16) of the staples (12) received in the staple magazine (32) and that the second lever arms (58) have end portions (66) beginning at their free ends (64) which are arranged offset to one another in the axial direction of the pivot axes (52) so that they move past one another as the anvil arm (26) approaches the base part (18), and wherein a thickness of the end portions (66) is at most half as large as a maximum thickness of the first lever arms (54).

* * * * *